United States Patent [19]

Dirksing et al.

[11] Patent Number: 4,819,935

[45] Date of Patent: Apr. 11, 1989

[54] TRAINING BAT FOR BALL GAMES

[76] Inventors: John L. Dirksing; William P. Dirksing, both of 5208 Horizonvue Dr., Cincinnati, Ohio 45239; John W. Dirksing, 6176 W. Fork, Cincinnati, Ohio

[21] Appl. No.: 127,778

[22] Filed: Dec. 2, 1987

Related U.S. Application Data

[63] Continuation of Ser. No. 822,101, Jan. 24, 1986, abandoned, which is a continuation-in-part of Ser. No. 722,820, Apr. 12, 1985, abandoned.

[51] Int. Cl.[4] ..... A63B 21/00

[52] U.S. Cl. ..... 272/124; 272/117; 273/26 B; 273/193 A

[58] Field of Search ..... 272/67, 117, 122, 123, 272/124, 127, 128, 143, 29 A, 63 E, 81 A, 186 A, 186 R, 193 A, 194 A, 194 B, 202; 273/26 B

[56] References Cited

U.S. PATENT DOCUMENTS

| | | | |
|---|---|---|---|
| 588,350 | 8/1897 | Perkins | 272/67 |
| 647,220 | 4/1900 | Courtney | 272/124 |
| 875,273 | 12/1907 | Kimble | 272/124 X |
| 3,136,546 | 6/1964 | Connolly | 273/26 B |
| 3,246,894 | 4/1966 | Salisbury | 273/26 B |
| 3,351,346 | 11/1967 | Strahan | 272/124 X |
| 3,414,260 | 12/1968 | Gust | 273/26 R |
| 3,422,719 | 1/1969 | Payson | 272/124 X |
| 3,521,883 | 7/1970 | Hamilton | 273/26 B |
| 3,572,706 | 3/1971 | Schroder | 273/26 R |
| 3,690,655 | 9/1972 | Chapman | 272/117 X |
| 3,716,239 | 2/1973 | Goudreau | 273/194 A |
| 3,809,397 | 5/1974 | Gruenewald | 273/26 B |
| 3,834,697 | 9/1974 | McNamare, Jr. et al. | 273/26 R |
| 3,897,058 | 7/1975 | Koch | 273/26 B |
| 3,971,559 | 7/1976 | Diforte, Jr. | 273/26 B |
| 4,142,721 | 3/1979 | Faleck et al. | 273/29 A X |
| 4,260,150 | 4/1981 | Tabet | 273/26 B |
| 4,274,631 | 6/1981 | Hayazaki | 273/26 B |
| 4,330,121 | 5/1982 | McCafferty | 273/26 B |
| 4,444,396 | 4/1984 | Wendt | 272/124 X |
| 4,537,394 | 8/1985 | Golidsky, Jr. | 272/117 |
| 4,555,111 | 11/1985 | Alvarez | 273/26 B |
| 4,682,773 | 7/1987 | Pomilia | 273/26 B |
| 4,763,899 | 8/1988 | Hundley | 273/26 B |

FOREIGN PATENT DOCUMENTS

| | | | |
|---|---|---|---|
| 70350 | 5/1915 | Austria . | |
| 503931 | 6/1920 | France | 272/124 |
| 15144 | 8/1894 | United Kingdom | 272/124 |
| 1609 | 3/1909 | United Kingdom | 272/124 |
| 257959 | 12/1926 | United Kingdom | 272/124 |
| 446726 | 5/1936 | United Kingdom . | |

*Primary Examiner*—Richard J. Apley
*Assistant Examiner*—Robert W. Bahr
*Attorney, Agent, or Firm*—Ronald J. Snyder

[57] ABSTRACT

A training bat for ball games is shown as including a handle, a ballast, and a ballast adjustment structure. The ballast adjustment structure further includes an adjustment stem attached to the handle, and ballast attachment structure connecting the ballast to the adjustment stem. The handle, stem and ballast are attached coaxially to one another, and the adjustment stem includes external thread convolutions formed along its axial length adapted to provide selective adjustability of the ballast relative the handle along the longitudinal axis of the bat. The selective adjustability of the ballast is provided by rotation of the ballast relative the handle while the handle, adjustment stem and ballast are integrally attached.

13 Claims, 6 Drawing Sheets

TRAINING BAT FOR BALL GAMES

CROSS-REFERENCE TO RELATED APPLICATION

This is a continuation of the prior co-pending application entitled "Training Device for Ball Games", Ser. No. 822,101, filed Jan. 24, 1986, now abandoned, in the names of the present inventors, which was a continuation-in-part of the prior co-pending application entitled "Training Bat", Ser. No. 722,820, filed Apr. 12, 1985, now abandoned, in the names of John L. Dirksing and William P. Dirksing.

TECHNICAL FIELD

This invention relates to a training device for ball games, and, more particularly, to an adjustable weighted training or warm-up device for ball games.

BACKGROUND ART

Persons who play baseball, softball, and similar sports, often use various devices and methods to improve their batting skills. For example, players may utilize a plurality of bats, a single bat with weighted collars or clamps and the like attached thereto, permanently weighted bats (e.g. hollowed out bats with solid or flowable weight materials included therewithin), or a bat with attached vanes or the like to effect aerodynamic drag. Such devices and methods are employed to facilitate general warming-up, stretching muscles, and developing the muscles used for batting, as well as to improve a player's bat speed, reaction skill, bat control, and the like. Swinging a plurality of bats can be awkward, and there is a limit as to how many bats a person can swing safely and/or comfortably.

A weighted collar for a ball bat is disclosed in U.S. Pat. No. 3,521,883, which issued to F. Hamilton on Nov. 27, 1967. The Hamilton collar comprises a rigid ring-like member adapted to slide over the handle of a bat and create an interference fit with the larger end thereof. Centrifugal force acts to hold the ring-like member in place as the bat is swung. A more complex collar is disclosed in U.S. Pat. No. 4,260,150, which issued to M. Tabet on Aug. 17, 1979. The Tabet collar comprises a resilient member disposed between two rigid members. The two rigid members serve to provide the weight to the device and to encapsulate the resilient member which serves to frictionally engage the bat. Such devices have, however, been found to be unsafe as they can become dislodged during swinging. Additionally, these devices are not adjustable because the position of the collar on the bat is generally predetermined by the interference of the inside diameter of the collar with the outside diameter of the barrel of the bat.

A weighted clamp for a bat is also disclosed in U.S. Pat. No. 3,834,697, which issued to J. McNamara on May 14, 1973. The McNamara device is similar in principle to the Hamilton and Tabet collars (e.g. supplemental weight added to a bat), however, the McNamara device is attached by clamping action instead of simple interference fit. Additionally, while its position along the bat is adjustable, the McNamara weighted clamp can also become dislodged during swinging.

A fixed or permanently weighted bat is disclosed in U.S. Pat. No. 3,246,894, which issued to L. Bratt on Mar. 11, 1974. The Bratt device includes sand ballast contained within the upper portion of its barrel. In order to change the weight of the Bratt bat, one must disassemble the barrel portion of the bat and add or remove sand or other flowable ballast.

Training devices that include vanes or the like to effect aerodynamic drag during swinging exercises are disclosed in U.S Pat. No. 3,809,397, which issued to B. Gruenewald on Apr. 3, 1972, and U.S. Pat. No. 4,330,121, which issued to J. McCafferty on Oct. 2, 1980. With such devices attached to the barrel of the bat, the batter experiences a resistance to the swinging motion as the vanes "push" through the air. The amount of resistance experienced by the batter is proportional to the angular velocity with which the bat is moved. Therefore, a batter must swing the bat faster to simulate additional bat weight, a requirement not always compatible with effective training or warm-up procedures.

As described above, despite all of the prior work done in this area, there remain problems of safety, adjustability, and convenience in incorporating weighted devices into training devices.

DISCLOSURE OF THE INVENTION

It is an object of the present invention to obviate the above described problems.

It is also an object of the present invention to provide a training device which is simple, safe, and affords the user the ability to easily adjust its effective weight.

It is also an object of the present invention to provide an adjustable weighted training bat which can be safely utilized.

In accordance with one aspect of the present invention, there is provided a training device for ball games including a handle, ballast means, and ballast adjustment means. In a preferred embodiment, the ballast adjustment means includes an adjustment stem secured to the handle and ballast attachment means. The ballast means is mounted on the adjustment stem and is adapted for movement therealong. The ballast attachment means is adapted to immovably secure the ballast along the adjustment stem at a predetermined position. The ballast means can, therefore, be easily and quickly adjusted to vary the effective weight and overall physical characteristics of the device.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
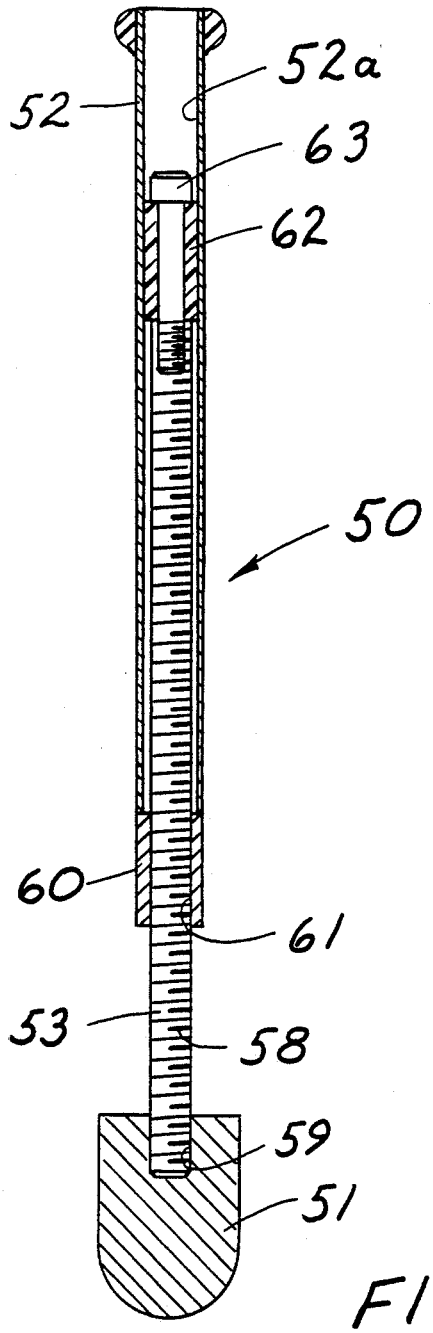
FIG. 1 is a cross-sectional elevation view of one embodiment of a training device embodying the present invention.

Referring now to the drawings in detail, wherein like numerals indicate the same elements throughout the views, FIG. 1 illustrates a training bat 50 including a handle 52, an adjustment stem 53, and a ballast means 51 attached to the distal end of adjustment stem 53. Adjustment stem 53 is adjustably attached to handle 52 and is thereby adapted to selectively secure ballast means 51 at a predetermined axial position relative the distal end of handle 52.

Adjustment stem 53 is illustrated as including external threads 58 which threadedly interact with internal threads 61 of adjustment sleeve 60 of handle 52 to provide adjustable attachment of stem 53 thereto. Additionally, external threads 58 interact with internal threads 59 of ballast means 51 to provide attachment of ballast means 51 to stem 53. Such threads are shown only as a preferred example of means for attaching ballast means 51 to stem 53 and for providing adjustable attachment of stem 53 to handle 52. Other means for accomplishing such attachment could equally be substituted by one skilled in the art.

Ballast means 51 can be permanently attached to stem 53, or, alternatively, can be made removable for replacement with similar ballast means of differing effective size, weight or shape. It is preferred for safety that adjustment stem 53 be equipped with a mean to ultimately limit its axial travel relative handle 52 to insure that stem 53 remains attached to handle 52. FIG. 1 shows a preferred means of providing such a limiting device, wherein bearing 62 is attached to the inner end of stem 53 by bolt 63. Bearing 62 is dimensioned to slidably fit within bore 52a of handle 52 and is designed to butt up against adjustment sleeve 60 thereby limiting the outward axial movement of stem 53 within handle 52. Again, other means of limiting axial adjustment of stem 53 could equally be utilized.

It is contemplated that ballast means 51 can be selectively adjusted relative the distal end of handle 52 along the longitudinal axis of bat 50 by rotational movement of stem 53. In this manner, the effective weight and characteristics of bat 50 can quickly and easily be adjusted by simply twisting ballast means 51 and adjustment stem 53 relative handle 52.

Figure 2:
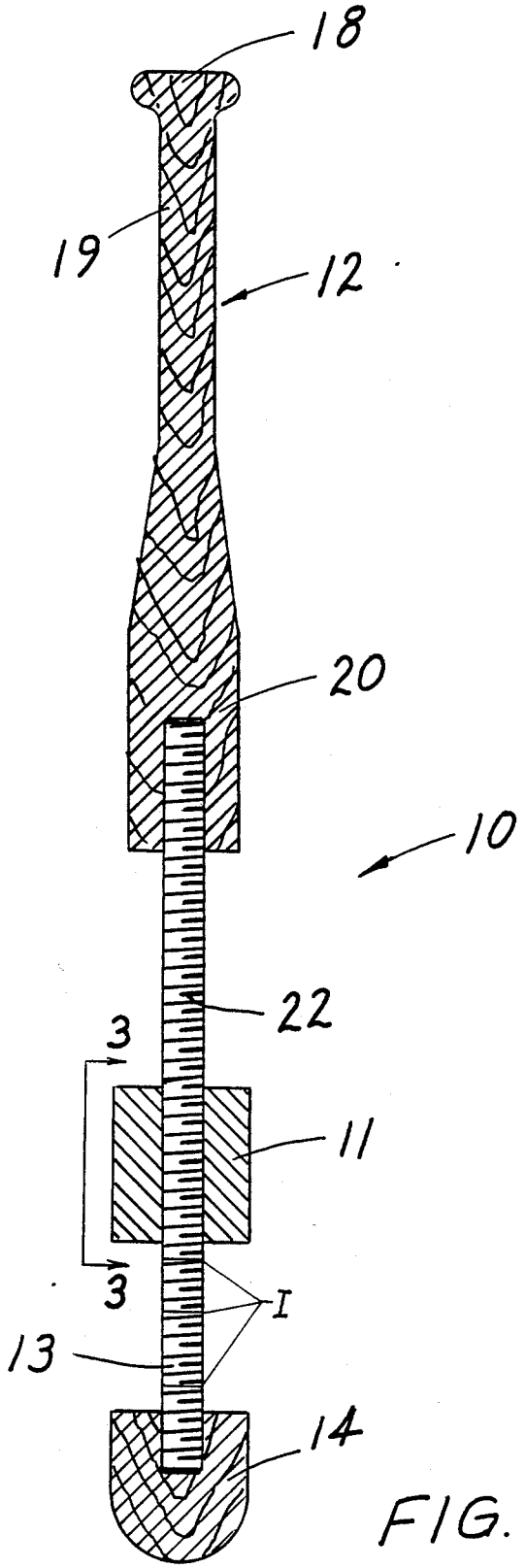
FIG. 2 is a cross-sectional elevational view of a preferred embodiment of a training device embodying the present invention.
Figure 3:
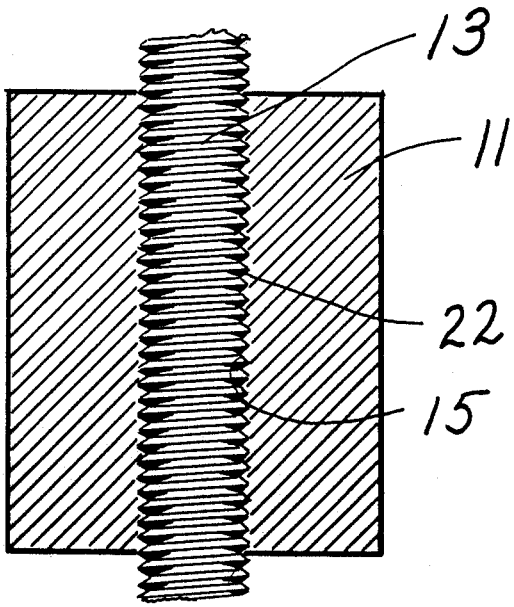
FIG. 3 is partial cross-sectional view of the training device of FIG. 2 taken on line 3—3 thereof.

Adjustment of a training bat made in accordance with the present invention can also be accomplished in alternative ways with minor changes in the manner in which the bat handle, adjustment stem, and ballast means are attached to one another. FIGS. 2 and 3 illustrate a preferred training bat 10 which includes handle 12, and a ballast means 11 that can be adjustably positioned and secured along an adjustment stem 13. Adjustment stem 13 is secured to handle 12 on one end, and to the ballast retention means 14 on the other end, as shown in FIG. 2. Adjustment stem 13 is also shown within the ballast 11 in FIG. 3. Adjustment stem 13, thereby, is substantially immovably secured to handle 12, and ballast means 11 can be selectively secured at a predetermined position therealong relative the distal end of said handle 12.

Bat handle 12 (or 52) made in accordance with the subject invention can be made of various materials (e.g. wood, metal, plastic, reinforced fiberglass, and the like), provided such material exhibits sufficient strength to safely be utilized as a weighted bat handle. For example, the material must feature characteristics which will minimize the possibility of catastrophic failure when submitted to the relatively high and sudden shear and bending moments commonly imposed on ball bats. In this regard, it might be desirable to externally reinforce the upper end of the handle, such as by placing a metal collar or sleeve (not shown) around the portion of handle 12 (or 52) where the adjustment stem is attached thereto. It is comtemplated that handle 12 can exhibit substantially standard size and shape in conformance with ball bats commonly found in the industry. For example, handle 12 might further comprise an end knob 18, grip portion 19, and enlarged portion 20, with grip portion 19 being substantially round in cross section and having a nominal diameter (or grip size) in a range of between about 25 millimeters (about 1 inch) and about 40 millimeters (about 1.625 inches). The specific size and shape of handle 12 is not critical, and may vary according to each specific application.

Adjustment stem 13 (or 53) made in accordance herewith can similarly be made of various sufficiently strong materials (e.g. metal, plastic, fiberglass, hard rubber, and the like), however, it is preferred that it be made of metal to insure adequate strength and durability. The length of adjustment stem 13 is not critical, however, it is preferred that such length be chosen to maximize the adjustability of ballast means 11 while insuring that the overall length of bat 10 remains within the generally accepted or required length of bats or similar devices in a particular sport. Likewise, the length of adjustment stem 53 of bat 50 should be chosen to maximize adjustability of ballast means 51 relative handle 52. It is preferred that the adjustment stem of the subject bat be substantially round in cross-section and have a nominal diameter in a range of between about 15 millimeters (about 0.625 inch) and about 25 millimeters (about 1 inch). It is also contemplated that adjustment stem 13 might extend into the handle 12 a sufficient length so as to better distribute any bending and shear loads along the above stated length of handle 12. Bearing 62 can preferably similarly be utilized to distribute loads within handle 52 of bat 50. Alternatively, adjustment stem 13 might be formed integrally with handle 12, or might be otherwise attached to the distal end of handle 12, or might extend inside the full length of handle 12. The specific means of attachment of adjustment stem 13 to handle 12 is not critical and, consequently, might vary according to desired manufacturing practices or specific materials used.

The ballast means 11 (or 51) made in accordance herewith can be made of various materials (e.g. metal, plastic material clad with metal, concrete clad with plastic, or the like) to provide the desired adjustable weight to bat 10 (or 50). The diameter of ballast 11 is not critical, however, it is preferred that such diameter be chosen so as to retain the overall appearance of a ball bat (i.e. 11 outside diameter of ballast 11 should be about equal to or less than the largest diameter of other elements such as ballast retention means 14). The length of ballast means 11 is not critical, however, it is preferred that such length be chosen to maximize the adjustability of ballast 11 along adjustment stem 13. The weight of ballast means 11 (or 51) can be varied according to the specific application and bat characteristics desired, however, it is preferred that such weight be in a range of between about 0.5 kilograms (about 1 pound) and about 5 kilograms (about 10 pounds). Such weight range is particularly preferred for training bats to be used for baseball and/or softball applications.

Ballast retention means 14 can conveniently be made of the same material as handle 12, although dissimilar material can often be preferred. For example, high impact plastic might be desirable for durability and crack-resistance. It is contemplated that ballast retention means 14 be substantially circular in cross-section and feature a nominal diameter in a range of between about 40 millimeters (about 1.625 inches) and about 75 millimeters (about 2.75 inches) to conform to standard ball bat size and appearance. Again, the length of the ballast retention means 14 is not critical, however, its length is preferred to be such that adequate engagement of the adjustment stem 13 and ballast retention means 14 be insured.

Preferably, the adjustment stem (13 or 53) of the subject invention is a metal shaft which has adjustment means formed thereon. For example, as shown in FIGS. 2 and 3, external thread convolutions 22 might be machined onto adjustment stem 13 for threaded interengagement with corresponding internal threads 15 formed within the central aperture of ballast 11. Such threaded interaction could provide substantially infinite adjustment of ballast means 11 along adjustment stem 12 in a safe and convenient manner. In a preferred embodiment, the lead or pitch of threads 15 and 22 is designed so as to allow for easy repositioning of ballast means 11, while allowing ballast means 11 to maintain a particular position along adjustment stem 13 without the need of additional locking devices. For this purpose, the lead or pitch of threads 15 and 22 might be similar to a standard course screw thread. It has been found that two pitches per millimeter (e.g. thread helix angle of about 2.6°) works well for an adjustment stem 13 having a core diameter of approximately 20 mm. It is contemplated that other ballast attachment means such as set screws, locking pins, or the like could easily be substituted for such threads.

The threaded feature of the adjustment stem of the subject invention also permits easy removal of a threaded ballast means from the distal end of the stem to facilitate the substitution of another ballast means of a different effective weight. For example, with regard to bat 10, this procedure is accomplished by first removing ballast retention means 14 from the upper end of adjustment stem 13, and thereafter simply rotating ballast means 11 off of the upper end of adjustment stem 13. Ballast retention means 14 may also include internal threads for convenient attachment over the external threads 22 of adjustment stem 13. For additional safety, it is preferred, however, that if ballast retention means 14 is to be removable, it should also include additional means (e.g. a set screw or pin, not shown) to positively secure it to adjustment stem 13.

Positioning of the ballast means of the subject invention in various locations along the adjustment stem effectively reflects a different rotational inertia to the person swinging the training bat. As players vary in their physical strength and personal preferences, those of lesser strength might locate the ballast means nearer that bat handle, while those of greater strength might locate the weight farther from distal end thereof. Therefore, no additional materials or unwieldy devices need be added to or removed from the training bat disclosed herein in order to adjust the weightd feel of the bat. By virtue of its unique structure, the subject training bat can safely accept a substantial amount of weight while retaining substantially all of the normal physical attributes of a common ball bat. This weight can create the effective swing resistance of four bats or more (e.g. 4 kg. or more) for the purpose of muscle development. On the other hand, the same training bat can conveniently and quickly be adjusted to create the effective swing resistance of two bats (e.g. 1.5 kilograms) for the purpose of warming-up before a game. Such easy adjustability, accurate simulation of bat characteristic and "feel", and safety have not been obtainable with training devices known heretofore. It is also contemplated that the adjustment stem of the subject training bat could simultaneously accommodate a plurality of ballast means arranged at various positions therealong.

Means of calibrating the effective weight of the training bat disclosed herein might also be included to facilitate use thereof by a multitude of players. For example, various color coded or otherwise clearly defined indicia (e.g. indicia I shown in FIG. 2) might be permanently placed along adjustment stem 13 to indicate predetermined ballast locations. A player need simply remember his preferred mark, then quickly adjust ballast means 11 on training bat 10 prior to his use thereof. Alternatively, if a spring loaded set pin arrangement were used as the ballast attachment means to secure ballast 11 at one or more positions along adjustment stem 13, pin locator holes could be spaced at predetermined points along adjustment stem 13 and likewise marked for easy player recognition. Similar indicia could be placed on adjustment stem 53 of training bat 50. Bat 10 might also be made with a removable handle 12 so that other handles featuring various grips, grip sizes, and/or handle lengths could be interchanged as desired. Or handle 12 could be removed to facilitate storage or shipping. This feature could easily be achieved in many ways by one of ordinary skill. For example, handle 12 could be threadedly attached to adjustment stem 13 as shown in FIG. 2.

Figure 4:
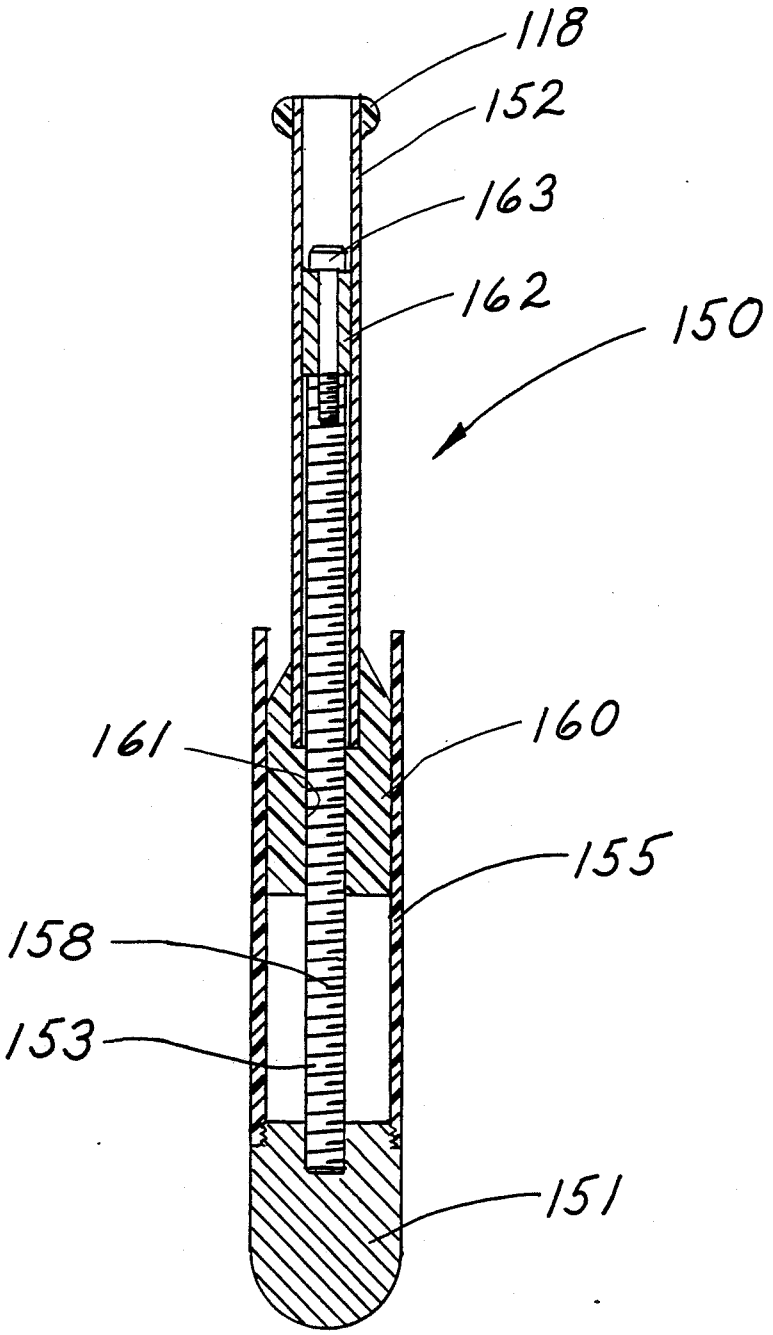
FIG. 4 is a cross-sectional elevational view of a third embodiment of a training device including a protective sleeve means.

FIG. 4 illustrates an alternate embodiment of the training device of the subject invention, and, more specifically, includes a slidably mounted protective sleeve means 155 adapted to telescopingly cover and protect adjustment stem 153 and at least a portion of ballast means 151. Training device 150 is substantially similar in structure and function to training bat 50 described above, however, device 150 includes a slightly modified adjustment sleeve 160. Since adjustment sleeve 60 further preferably serves to support the inner surfaces of protective sleeve means 155, it shall be referred to here as sleeve support 160. Sleeve support 160 preferably has a larger outer diameter than the corresponding adjustment sleeve 60 (of FIG. 1) in order to provide such preferred support for the inner lower surfaces of protective sleeve 155. Protective sleeve means 155 is illustrated as being a substantially thin-walled, hollow tube attached to the lower end of ballast means 151 and having an internal diameter designed to easily slide over the upper portions (in particular over sleeve support 160) of handle 152 as training device 150 is adjusted. As illustrated in FIG. 4, handle 152 might preferably comprise a hollow tube of rigid material such as metal or high-impact plastic resin, and having an end knob 118 attached on its lower end and a sleeve support 160 attached at its upper end. Sleeve support 160 should also be relatively rigid to adequately support sleeve 155, as shown. Adjustment stem 153 is preferably immovably anchored to handle 152, such as by bearing 162 and bolt 163.

It is contemplated that sleeve means 155 can be made of any impact resistant material such as polyvinyl chloride, hard rubber, fiberglass, metal, or the like. Sleeve means 155 might also be made of more flexible material to function as an extendable/collapsible boot-like member. However, it is preferred that sleeve 155 be made of relatively rigid material. because sleeve means 155 is contemplated to function as a safety device, not only to protect adjustment stem 153 during use of the training device, but also to protect the user from contact with adjustment stem 153 and its threads 158. It is contemplated that any training device made in accordance with the subject invention (e.g. training bats 50 or 10) could be fitted with a protective sleeve such as sleeve 155. As an example, protective sleeve 155 is illustrated in FIG. 4 as having an inside diameter slightly larger than the outside diameter of handle 152 for relative ease in sliding thereover. The thickness of the walls of sleeve 155 can vary according to the material used therein. For example, if sleeve 155 is made of polyvinyl chloride material, hollow sleeve 155 having an inside diameter of 50.8 mm (2.0 inches) might preferably have a wall thickness of approximately 8.25 mm (0.325"). The overall length of the sleeve 155 can also vary, but should be sufficient to allow attachment to ballast means 151 with some overlap on its distal end over sleeve support 160 when the training device is fully extended. Sleeve 153 is shown as being threadedly attached to ballast means 151 as an example of a means of achieving such attachment. It is contemplated that sleeve 153 could be attached to ballast means 151 in any manner known or conceivable by one skilled in the art, such as by pinning, adhesives, or the like.

Figure 5:
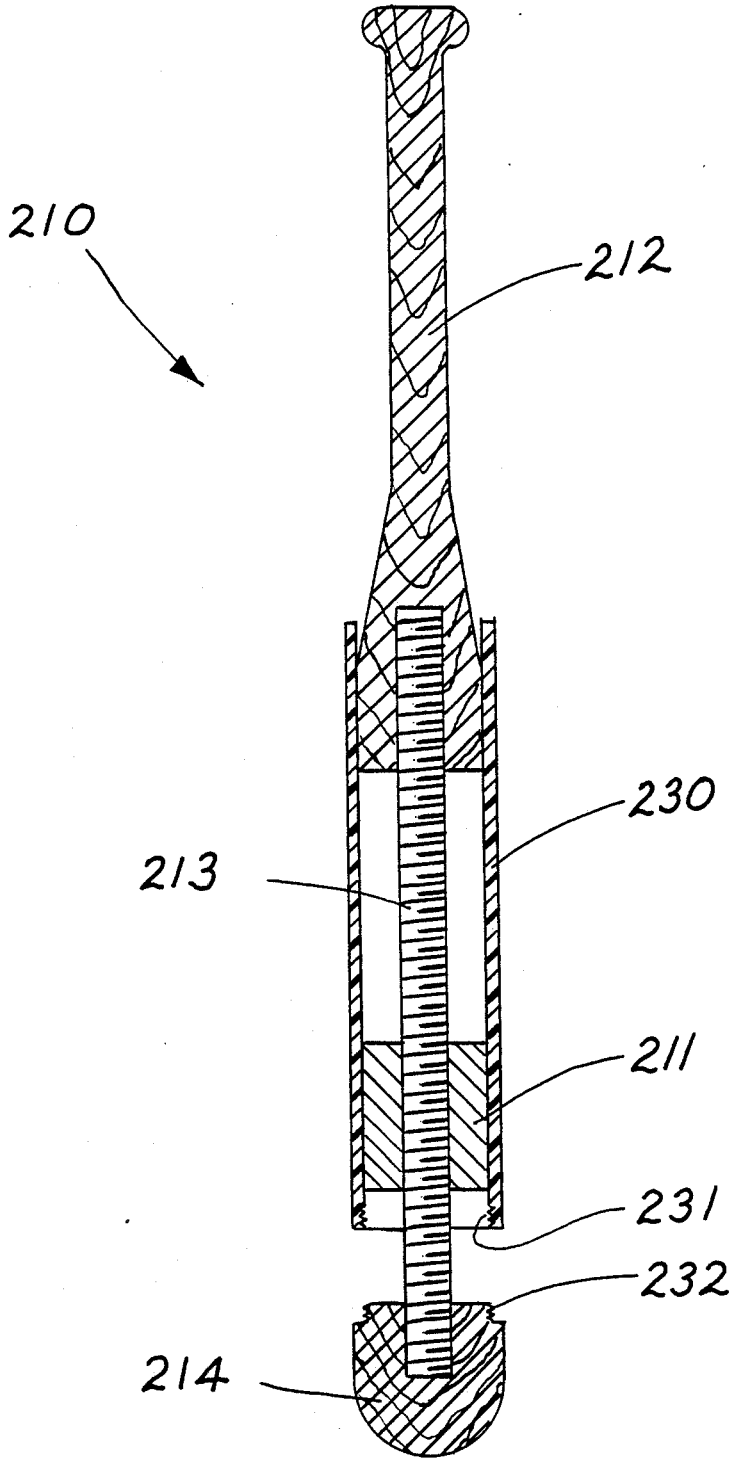
FIG. 5 is a cross-sectional elevational view of a fourth embodiment of a training device including a protective sleeve means.

FIG. 5 illustrates another embodiment of the subject invention substantially identical to the training bat 10 described above with regard to FIGS. 2 and 3; however, training device 210 of FIG. 5 has been modified to include a protective sleeve 230 similar to protective sleeve 155 described above. As shown, sleeve 230 is preferably designed to slidably mount over handle 212 such that it can telescope over ballast means 211 and ballast adjustment means 213 to provide a protective sleeve thereover. As shown, in a training device 210 including ballast means 211, protective sleeve 230 can be adapted to attach a ballast retention means 214. Corresponding threads 231 and 232 are shown as an example of a means to attach sleeve 230 to ballast retention means 214; however, other means such as snap-fit arrangements, friction fits, etc. could equally be substituted. It is contemplated that sleeve 230 can be telescoped over ballast means 211 and ballast adjustment means 213 during use of the training device 210, while sleeve 230 can be released from retention means 210 and moved downwardly to provide access to said adjustment means 213 and ballast means 211 when adjustment of ballast 211 is desired. In this manner, protective sleeve 230 provides protection for adjustment stem 213 and ballast means 211 during training use of device 210, while providing access to the ballast means and ballast adjustment means when desired. Consequently, sleeve 230 provides a means for making device 210 safer in use, while providing protection of adjustment means 213 and ballast means 211 against dirt, damage, and the like.

Figure 6:
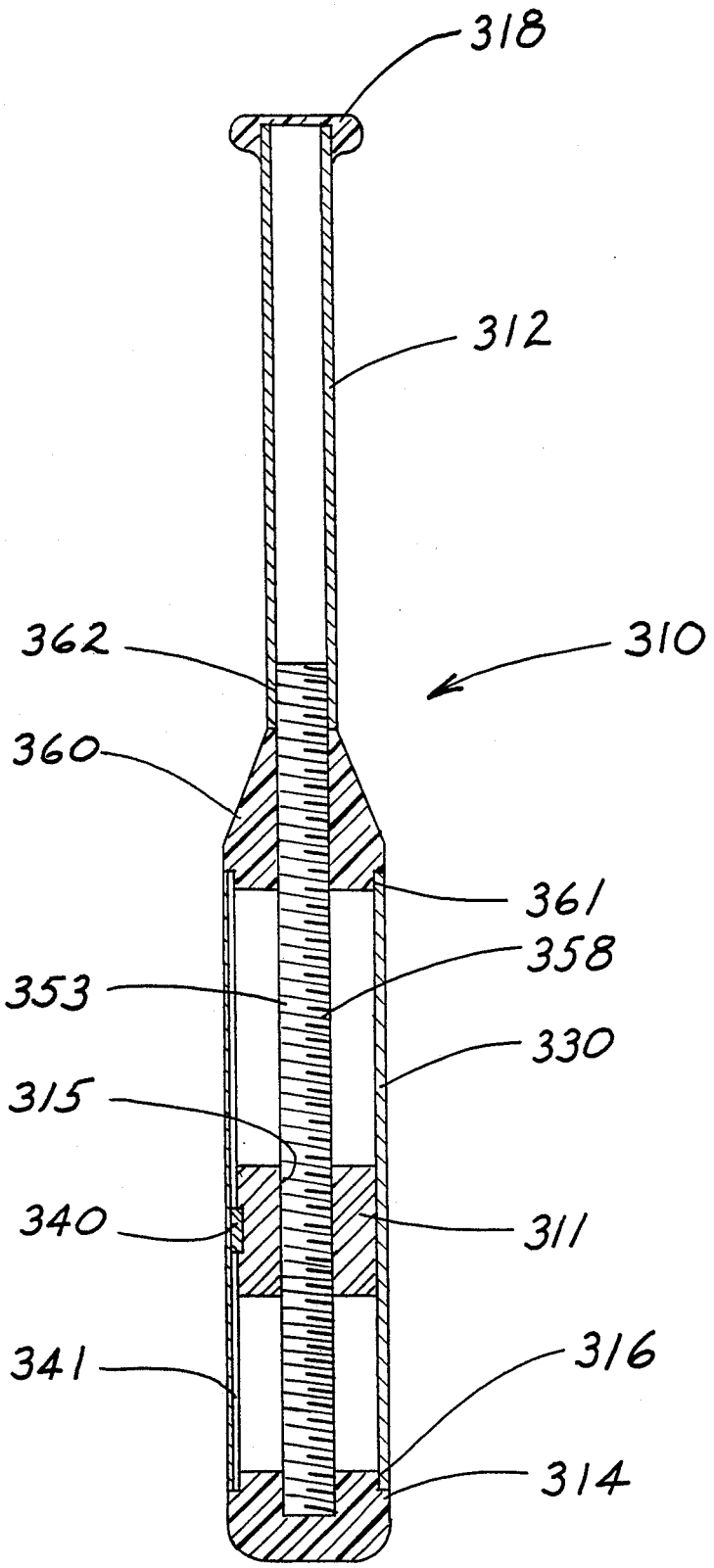
FIG. 6 is a cross-sectional elevational view of a fifth embodiment of a training device of the subject invention including a protective sleeve means.

FIG. 6 shows yet another embodiment of a training device 310 similar to device 150 of FIG. 4, however, training device 310 includes a protective sleeve 330 permanently rotatably mounted in telescoped position over adjustment stem 353 and ballast means 311. Training device 310 comprises a handle 312, sleeve support means 360 mounted on the upper end of handle 312, adjustment stem 353 attached to sleeve support means 360 and handle 312 (shown at 362 as a threaded attachment), end knob 318 attached to the lower end of handle 312, ballast means 311, and ballast retention means 314 attached to the distal end of adjustment stem 353. Ballast means 311 is illustrated as being rotatably mounted on adjustment stem 353 by the interaction of external threads 358 of adjustment stem 353 and internal threads 315 of ballast means 311.

Sleeve 330 is rotatably mounted between sleeve support means 360 and ballast retention means 314 over ballast means 311 and adjustment stem 353. As an example of how sleeve 330 can be permanently, rotatably mounted over ballast means 311, sleeve support means 360 includes a sleeve bearing portion 361 over which sleeve 330 can be snugly fit for rotation thereabout. Similarly, ballast retention means 314 includes a sleeve bearing portion 316. In this way, ballast retention means 314 is attached to the distal end of adjustment stem 353 effectively permanently mounting protective sleeve 330 on training device 310. Sleeve support means 360 and ballast retention means 314 can be made of any relatively rigid material such as metal, wood, high-impact plastic resin, or the like.

Protective sleeve 330 further includes a longitudinal slot 341 formed along its inner surfaces to lockingly interact with ballast interlocking means 340 to interlock ballast means 311 with sleeve 330. Interlock means 340 is illustrated as being an outwardly extending stud or key, as an example of a preferred means. The slot 341 and interlocking means 340 create a sliding "keyway" which permits rotation of sleeve 330 relative to handle 312 to cause ballast means 311 to be adjusted along adjustment stem 353 as it is rotated thereabout with sleeve 330. Training device 310 consequently functions in a manner substantially identical to training device 210, described above, except that adjustment of ballast means 311 is accomplished via rotation of sleeve 330. It is contemplated that any means of interlocking sleeve 330 and ballast means 311 to prevent relative rotation therebetween could be utilized herein, and the keyway-/interlock means described above is meant only to show a preferred example of such.

It is contemplated that where protective sleeve 330 is to be permanently rotatably mounted between handle 312 and ballast retention means 314, sleeve 330 is preferably additionally equipped with a ballast locater means (not illustrated) so that a user can readily tell the relative position of ballast means 311 along ballast adjustment stem 353 within the protective sleeve 330. For example, ballast locater means could comprise a clear or semi-transparent portion formed in sleeve 330; or a longitudinal viewing window could be formed in sleeve 330 whereby the relative position of ballast means 211 could easily be seen.

It is contemplated that in all embodiments including a protective sleeve member, it is preferred that the outer shape of the sleeve member appropriately conform to the outer conformation of the training device handle and any ballast retention means formed thereon. In this way substantially uniform overall outer conformation of the training device can be maintained. For example, the outer shape of a conventional baseball or softball bat can be achieved in a training device made in accordance herewith.

Having shown and described the preferred embodiment of the present invention, further adaptions thereof can be accomplished by appropriate modifications by one of ordinary skill in the art without departing from the scope of the present invention. For example, while the training device of the subject invention has been shown and described with reference to a training bat for ball games, it could also be easily incorporated into training clubs for golf, training rackets for tennis, and the like. Accordingly, the scope of the present invention should be considered in terms of the following claims, and understood not to be limited to the details of structure and function shown and described in the specification and drawings.

We claim:

1. An adjustably weighted training bat for ball games, said bat comprising a handle which conforms substantially to standard size and shape characteristics of ball bats and having a grip portion and end knob to provide for safe handling and use of the bat, a ballast means, and a ballast adjustment means, said ballast adjustment means further comprising an adjustment stem attached to said handle and ballast attachment means connecting said ballast means to said adjustment stem, said handle, stem and ballast means being attached coaxially to one another, said ballast attachment means including external thread convolutions formed along the axial length of said adjustment stem adapted to provide selective adjustability of said ballast means relative said handle along the longitudinal axis of said bat by rotation of said ballast means relative said handle while said handle, adjustment stem and ballast means are integrally attached.

2. The training bat of claim 1, wherein said ballast means is substantially immoveably connected to said adjustment stem, and wherein said adjustment stem is adjustably attached to said handle and adapted to provide said selective adjustability of said ballast means relative said handle by rotation of said ballast means and said stem relative said handle.

3. The training bat of claim 1, further comprising calibration means to facilitate accurate adjustment of said ballast means to a predetermined position along said adjustment stem.

4. The training bat of claim 1, wherein said ballast adjustment means comprises internal threads formed within said ballast means to adjustably mount said ballast means on said adjustment stem, said ballast means being thereby adapted to be selectively secured along said adjustment stem at a predetermined position relative said handle by rotation of said ballast means relative said stem.

5. The training bat of claim 4, further comprising sleeve means adapted to be telescopingly mounted over said ballast means and said adjustment stem.

6. The training bat of claim 4, said bat further comprising ballast retention means attached to the distal end of said adjustment stem.

7. An adjustable weighted training bat for ball games, said bat comprising a handle which conforms substantially to standard size and shape characteristics of ball bats and having a grip portion and end knob to provide for safe handling and use of the bat, an adjustment stem attached to said handle, ballast means mounted on said adjustment stem for adjustable movement therealong, ballast attachment means to selectively secure said ballast means at a predetermined position along said adjustment stem, and ballast retention means attached to the distal end of said adjustment means, said handle, adjustment stem, and ballast means being integrally attached to one another substantially coaxially, and said adjustment stem and said ballast means including corresponding interacting threads to provide said selective securement of said ballast means along the longitudinal axis of said bat by rotation of said ballast means relative said handle while said handle, adjustment stem and ballast means remain integrally attached.

8. The training bat of claim 7, further comprising calibration means to facilitate accurate adjustment of said ballast means to a predetermined position along said adjustment stem.

9. The training bat of claim 7, further comprising sleeve means reciprocally mounted on said bat and adapted to telescope over said adjustment stem and said ballast means.

10. The training bat of claim 9, wherein said sleeve comprises a substantially hollow tube telescopingly mounted on said handle to provide intermittent access to said ballast means and said adjustment means as desired, and to cover said ballast means, said adjustment means and said adjustment stem when said training bat is in use.

11. The training device of claim 9, said device further comprising interlocking means adapted to connect said ballast means to said sleeve means whereby rotation of said sleeve means causes said ballast means to be selectively adjusted along said adjustment stem as desired.

12. An adjustably weighted training bat for ball games, said bat comprising a handle which conforms substantially to standard size and shape characteristics of ball bats and having a grip portion and end knob to provide for safe handling and use of the bat, ballast means, an externally threaded adjustment stem, and sleeve means, said ballast means being attached to said adjustment stem, said handle, adjustment stem, and ballast means being coaxially attached along a longitudinal bat axis, said ballast means being selectively adjustable relative said handle along said longitudinal axis by rotation of said ballast means relative said handle while said handle, adjustment stem and ballast means remain integrally attached, said sleeve means being adapted to telescope over said adjustment stem and said ballast means.

13. The training bat of claim 12, said bat further comprising interlocking means adapted to connect said ballast means and said sleeve means such that rotation of said sleeve means relative said handle causes said ballast means to be selectively adjusted relative said handle, as desired.

* * * * *